United States Patent [19]

Kupper

[11] Patent Number: 4,978,081

[45] Date of Patent: Dec. 18, 1990

[54] METHOD AND APPARATUS FOR DISPOSING THE YARN END OF A PACKAGE IN A FURTHER HANDLING DISPOSITION

[75] Inventor: Wilhelm Kupper, Wegberg, Fed. Rep. of Germany

[73] Assignee: W. Schlafhorst & Co., Monchen-Gladbach, Fed. Rep. of Germany

[21] Appl. No.: 415,881

[22] Filed: Oct. 2, 1989

[30] Foreign Application Priority Data

Sep. 30, 1988 [DE] Fed. Rep. of Germany ..... 3833258

[51] Int. Cl.[5] ..... B65H 54/22; B65H 54/20; D01H 9/18

[52] U.S. Cl. ..... 242/35.50 R; 57/276; 57/281; 242/35.5 A; 242/35.6 R

[58] Field of Search ..... 57/281, 266, 270, 276; 242/18 R, 35.5 A, 35.5 R, 35.6 R, 35.6 E

[56] References Cited

U.S. PATENT DOCUMENTS

| | | | |
|---|---|---|---|
| 3,544,018 | 12/1970 | Stoppard et al. | 242/35.6 R |
| 4,508,227 | 4/1985 | Kupper | 242/35.6 R X |
| 4,544,107 | 10/1985 | Matsui et al. | 242/35.5 A |
| 4,605,177 | 8/1986 | Uchida et al. | 242/35.5 A |
| 4,616,789 | 10/1986 | Matsui et al. | 242/35.5 R |
| 4,735,369 | 4/1988 | Suzuki | 242/18 R |
| 4,798,348 | 1/1989 | Matsui et al. | 242/35.6 E |
| 4,844,357 | 7/1989 | Kiriake | 242/18 R |

*Primary Examiner*—John Petrakes

*Attorney, Agent, or Firm*—Shefte, Pinckney & Sawyer

[57] ABSTRACT

A method and apparatus for disposing the yarn end of a package in a further handling disposition such as, for example, in the tube of the package, is provided. A preliminarily repositioning device receives packages from a ring spinning machine or the like, some of the packaging having their yarn ends in a preferred preliminary disposition and other of the packages having their yarn ends in a disposition displaced from the preferred preliminary disposition. The preliminarily repositioning device repositions the yarn ends of packages having displaced yarn ends from a displaced disposition to the preferred preliminary disposition. Thereafter, a relocating device relocates the yarn end of each package having its yarn end in the preferred preliminary disposition from that disposition to the further handling disposition. An advancing device advances packages between the preliminarily repositioning device and the relocating device. According to one aspect of the present invention, packages are ejected to a manual handling site for manual positioning of the package yarn end in the preferred preliminary disposition after a predetermined number of cycles of the package through the preliminarily repositioning device and the relocating device.

20 Claims, 4 Drawing Sheets

METHOD AND APPARATUS FOR DISPOSING THE YARN END OF A PACKAGE IN A FURTHER HANDLING DISPOSITION

BACKGROUND OF THE INVENTION

The present invention relates to a method and apparatus for disposing the yarn end of a yarn package in a further handling disposition and, more particularly, to a method and apparatus for disposing the yarn end of a package in the tube of the package.

A textile machine such as a ring spinning machine is operable to build yarn onto a tube to form a yarn packge. The yarn packages may then be further handled by another type of textile machine, such as, for example, a winding machine which winds yarn from the yarn package to a larger package. In such an arrangement, the yarn packages, once they are completed at the ring spinning machine, are transferred to the winding machine for unwinding thereat.

The efficiency of the winding machine can be enhanced if the yarn ends of the yarn packages are uniformly located at a predetermined location on the yarn packages so that the yarn ends can be readily located at the winding machine for engagement thereby to initiate the unwinding of the yarn from the yarn packages. In U.S. Pat. Nos. 4,508,227 and 4,605,177, devices are disclosed for disposing the yarn end of a yarn package in a dispositon for further handling. However, the need still exists for a method and apparatus for disposing a yarn end of a yarn package in a disposition for further handling in an efficient automatic manner and that does so with a minimum of handling of the packages.

SUMMARY OF THE INVENTION

Briefly described, the present invention provides an appartatus for disposing the yarn end of each of a plurality of packages in a further handling disposition, each package being of the type having yarn built onto a tube and some of the packages having their yarn ends in a preferred preliminary disposition and other of the packages having their yarn ends in a disposition displaced from the preferred preliminary disposition. The apparatus includes means for preliminary repositioning the yarn ends of packages having displaced yarn ends from a displaced disposition to the preferred preliminary disposition, means for relocating the yarn ends of packages having yarn ends in the preferred preliminary disposition from the preferred preliminary disposition to the further handling disposition and means for advancing packages between the preliminarily repositioning means and the relocating means.

According to one aspect of the present invention, the preferred preliminary disposition of a yarn end of a package is a disposition within a predetermined, relatively limited axial extent of the package and the relocating means includes an assembly for engaging a yarn end of a package disposed within the predetermined. relatively limited axial extent of the package.

Preferably, the further handling disposition of a yarn end of a package is a disposition in the end of the tube of the package and the engaging assembly includes a component for disposing a yarn end into the tube of a package.

In one embodiment, the engaging assembly includes a device for cutting a yarn end removed from the predetermined, relatively limited axial extent of the package to a predetermined length and a device for applying suction to the exterior of a package to within the predetermined, relatively limited axial extent of the package. Additionally, the disposing component includes a member for applying suction through the tube to draw the yarn end into the tube in the direction of the suction.

Preferably, the device for cutting a yarn end includes a device, cooperatively operated with the device for applying a suction to the exterior of a package, to cut a predetermined length a yarn end drawn into the device for applying a suction to the exterior of a package.

According to a further aspect of the present invention, the apparatus includes means for identifying packages having yarn ends displaced from the preferred preliminary disposition, the preliminarily repositioning means being responsive to the identifying means to change the disposition of the yarn end of a package, identified by the identifying means as displaced, from the displaced disposition to the preferred preliminary disposition. Also, the apparatus includes means, operatively connected to the advancing means, for discharging from the advancing means packages which still have yarn ends in a displaced disposition after a predetermined number of cycles of handling by the relocating means.

Preferably, the preliminarily repositioning means includes an assembly, operatively connected to the advancing means, for rotating a package about its axis, a device for applying a suction substantially along the axial extent of a package being rotated by the package rotating assembly to effect unwinding of a yarn end from the package and a device for cutting to a predetermined length a yarn end drawn into the suction device. Furthermore, the preliminarily repositioning means includes a sensing device for sensing the presence of a yarn end in the suction device.

Preferably, the advancing means includes a device for cyclically moving packages between the relocating means and the preliminarily repositioning means and the discharging means is selectively de-activated to permit movement of packages by the cyclical moving device.

Preferably, the apparatus also includes control means, connected to the preliminarily repositioning means, the relocating means and the advancing means, for coordinating the operation of the respective means with one another and the disposing means includes a sensing device for sensing the presence of a yarn end and the control means de-activates the disposing means when the sensing device senses that no yarn end is present.

According to another embodiment of the apparatus of the present invention, the advancing means includes a first cycling device for cyclically moving packages in a loop to the relocating means for handling thereby, a second cycling device for cyclically moving packages in a loop to the preliminarily repositioning means for handling thereby, an interconnecting transport assembly for transporting a package from the first cycling device to the second cycling device in response to a signal from the identifying means indicating that the package has its yarn end in a displaced disposition, and a return transport assembly for transporting a package from the second cycling device to the first cycling device, after the package has been handled by the preliminarily repositioning means to reposition its yarn end from a displaced disposition to the preferred preliminary disposition.

The present invention also provides a method for disposing the yarn end of each of a pluralilty of packages in a further handling disposition, each package being of the type having yarn built onto a tube and some of the packages having their yarn ends in a preferred preliminary disposition and other of the packages having their yarn ends in a disposition displaced from the preferred preliminary dispositon.

The method includes preliminarily repositioning the yarn ends of packages having displaced yarn ends from a displaced disposition to the preferred preliminary dispositon and relocating the yarn ends of packages having yarn ends in the preferred preliminary disposition from the preferred preliminary disposition to the further handling disposition.

DETAILED DESCRIPTION OF THE PREFERRED EMBODIMENT

Figures 1, 2, 3:
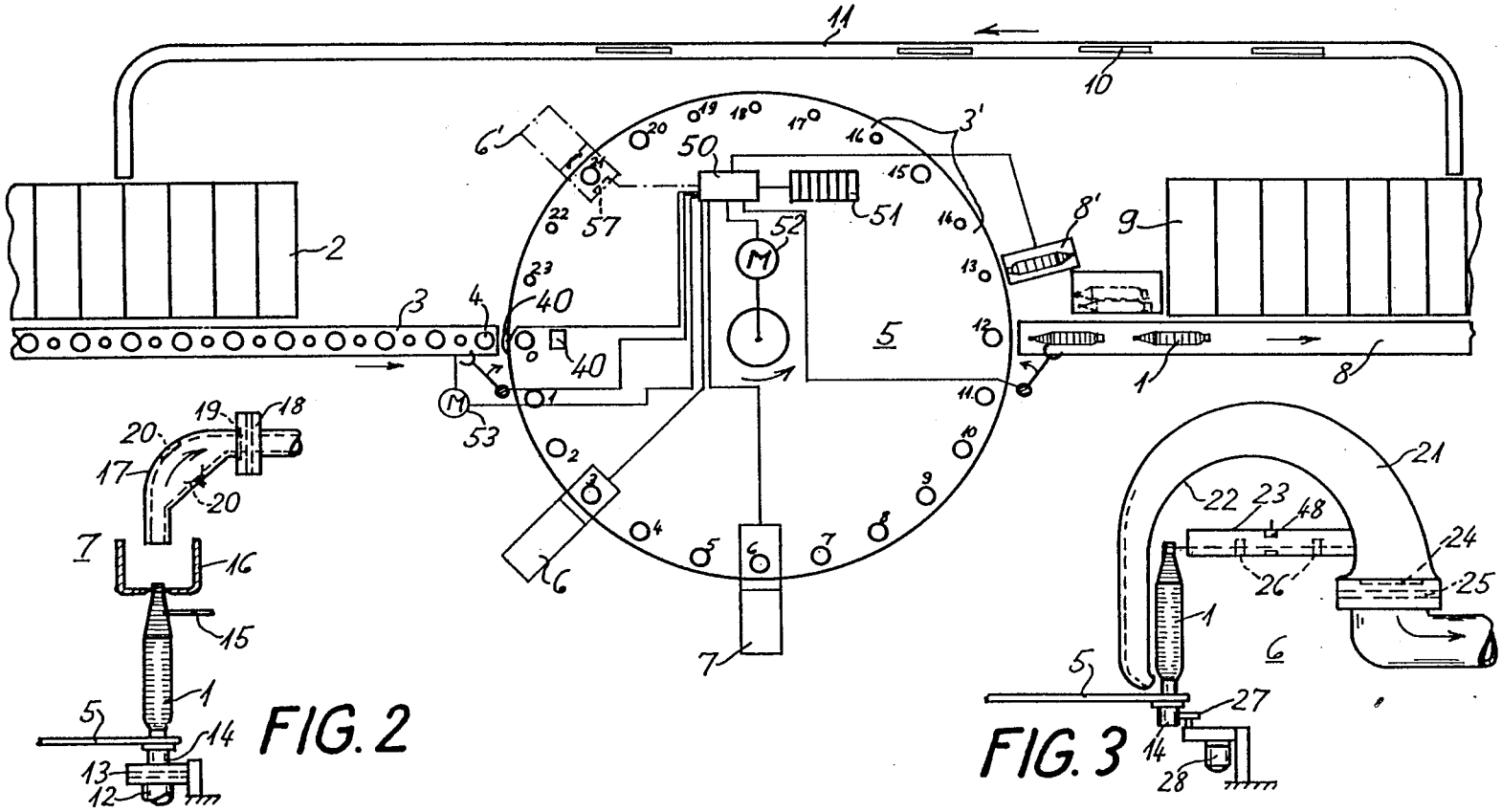
FIG. 1 is a plan view of one embodiment of the yarn end disposing apparatus of the present invention, showing the apparatus in its operating location intermediate to a ring spinning machine and a winding machine.
FIG. 2 is a partial front elevational view of the yarn end relocating means of the yarn end disposing apparatus illustrated in FIG. 1.
FIG. 3 is a partial front elevational view of the preliminarily repositioning means of the yarn end disposing apparatus shown in FIG. 1.

In FIGS. 1–5, one embodiment of the yarn end disposing apparatus of the present invention is illustrated. A ring spinning machine 2 builds yarn onto a plurality of tubes 10 to form a pluraltity of yarn packages 1 and the completed yarn packages 1 are transported via a conventional package transport assembly 3 to a transfer location 4 for transfer from the transfer location 4 to a conventional yarn package transport assembly 8. The yarn package transport assembly 8 delivers the yarn packages to a winding station 9 for further handling thereat. In accordance with the present invention, a method and apparatus are provided for disposing the yarn ends of the packages into a further handling disposition for ready handling by the winding machine 9. Once the winding machine 9 has unwound the yarn from a yarn package, the now empty tube 10 of the package is returned via a conventional tube return assembly 11 to the spinning machine 2 for the building of another yarn package onto the tube.

As can be understood, the packages have their yarn ends disposed in variously random axial dispostitions with respect to the packages as they are completed by the ring spinning machine 2. To enhance the efficiency of the winding machine 9, it is preferable that the yarn ends of the yarn packages be uniformly disposed in a predetermined further handling disposition on the yarn packages so that the winding machine 9 can readily locate and engage the yarn ends to initiate the winding operation. For example, it is preferable that the yarn ends be of a predetermined length and be diposed in the tube of the yarn package, whereby the winding machine 9 can be configured to automatically search for the yarn end of the arriving yarn packages in the tubes thereof.

In accordance with the present invention, an apparatus is provided for disposing the yarn ends of the packages 1 in a further handling disposition. Some of the packages 1 arrive at the transfer location with their yarn ends already in a preferred preliminary disposition and other packages 1 arrive at the transfer location 4 with their yarn ends in a dispositon displaced from the preferred preliminary disposition. The preferred preliminary disposition can be, for example, within a predetermined, relatively axial extent of the package. A means for preliminarily repositioning the yarn ends of packages having displaced yarn ends from a displaced disposition to the preferred preliminary dispositon is generally designated at 6. A means for relocating the yarn ends of packages having yarn ends in the preferred preliminary disposition from the preferred preliminary disposition to the further handling disposition is generally designated as 7. A means for advancing the packages 1 between the preliminarily repositioning means 6 and the relocating means 7 is generally designated as 5.

The advancing means 5 includes a rotating disk assembly having a plurality of angularly uniformly spaced package receiving devices, numbered 0–23, for receiving the packages 1 individually thereon. The rotating disk assembly is driven by a motor 52. The motor 52 is operatively connected via a connector to a control unit 50. Additionally, the preliminarily repositioning means 6 and the relocating means 7 are operatively connected to the control unit 50 and the control unit cooperatively controls the operation of the preliminarily repositioning means 6, the relocating means 7 and the advancing means 5.

The transfer location 4 includes a conventional transfer device operatively connected to the control unit 50 for individually transferring a package 1 from the yarn package transport assembly 3 onto one of the package receiving devices 0–23 of the rotating disk assembly. A conventional sensor 40, operatively connected to the control unit 50, is positioned relative to the transfer location 4 to sense the disposition of the yarn ends of the packages 1 arriving at the transfer location 4.

The yarn package transport assembly 3 is driven by a conventional motor 53 and the motor 53 is operatively connected to the control unit 50. A conventional yarn package transfer device is operatively connected to the control unit 50 and positioned adjacent the yarn package transport assembly 8 for transferring yarn packages from the rotating disk assembly to the yarn package transport assembly 8. A defective package discharge assembly 8' is operatively connected to the control unit 50. A conventional counting mechanism such as, for example, a shift register 51, is operatively connected to the control unit 50.

Figure 4:
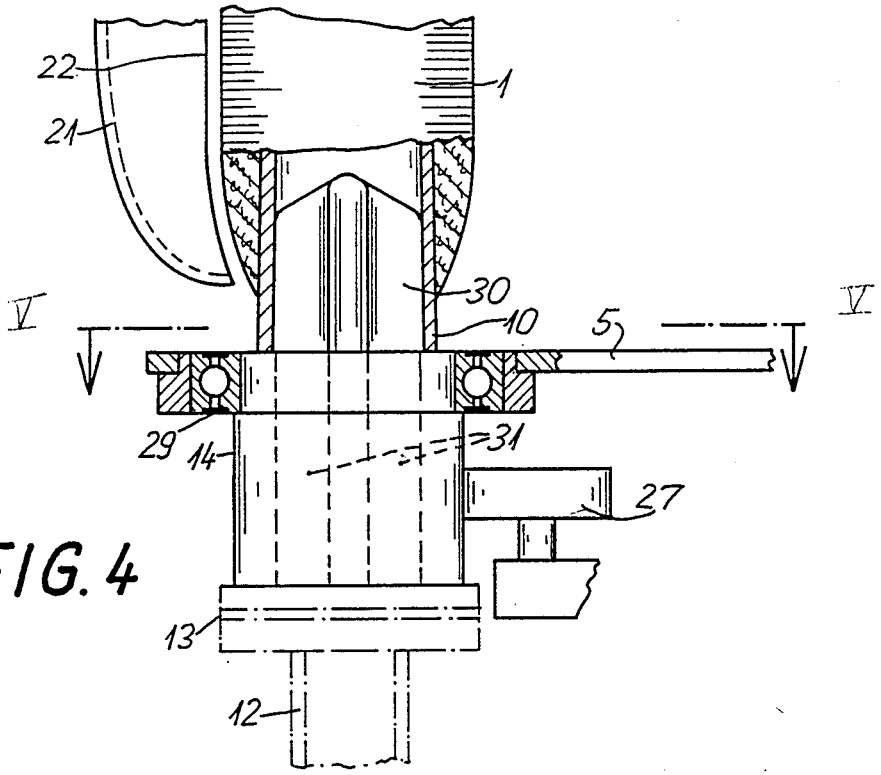
FIG. 4 is an enlarged partial vertical section of the preliminarily repositioning means shown in FIG. 3.
Figure 5:
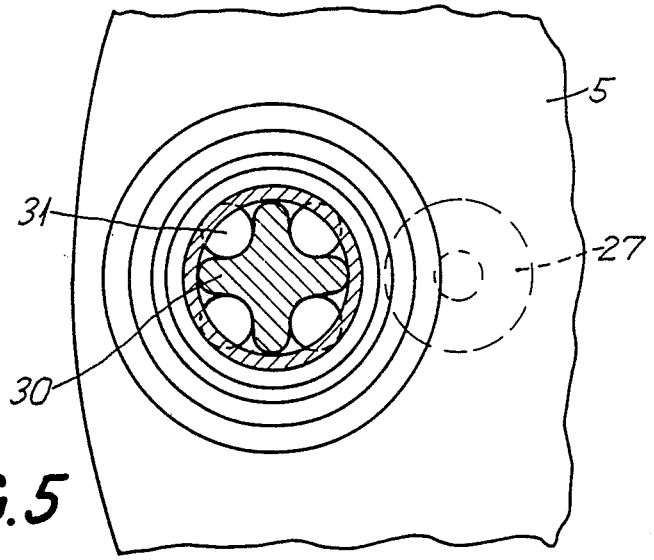
FIG. 5 is a horizontal sectional view of the preliminarily repositioning means shown in FIG. 4, taken along line V—V of FIG. 4.

With further regard now to FIGS. 4 and 5, one form of the package receiving devices 0–23 of the rotating disk assembly of the advancing means 5 is illustrated. A spindle includes an insert stem 30 configured for relatively snugly receiving the tube 10 of a package 1 inserted thereon and a drive whorl 14 mounted to one end of the insert stems 30. The spindle is rotatably mounted in the rotating disk assembly by a conventional ball bearing assembly 29 for rotation of the insert stem 30 about its axis. The cross-sectional shape of the insert stem 30 is such that a plurality of axially extending air guide channels 31 are formed between the insert stem 30 and the interior of the tube 10 inserted thereon. The air guide channels 31 extend through the drive whorl 14.

With further regard now to FIG. 3, the preliminarily repositioning means 6 will be described in further detail. A device 21 for applying a suction substantially along the axial extent of a package 1 includes a suction tube 22 communicated with a suction source (not shown). The suction tube 22 includes a slot having an extent corresponding to the axial extent of a package 1 and the suction tube 22 is positioned such that its slot is relatively closely adjacent a package 1 supported at the preliminarily repositioning means 6 by the rotating disk assembly of the advancing means 5.

A generally horizontally extending conduit 23 is connected to, and communicated with, the suction tube 22 and is positioned with its free end relatively closely adjacent the upper end portion of the tube 10 of the package 1 positioned at the preliminarily repositioning means 6. The conduit 23 includes a pair of spaced yarn guides 26 and a sensor 48 for sensing the presence of a yarn end within the conduit. The device 21 includes a conventional yarn cutting component 24 positioned in the suction tube 11 downstream of the conduit 23 and a valve 25 for controlling the application of a suction through the suction tube 22 and the conduit 23.

The preliminarily repositioning means 6 further includes a drive disk 27 positioned for engaging the drive whorl 14 of the spindle supporting the package 1 at the preliminarily repositioning means 6 for driving rotation of the tube 10 about its axis. The drive disk 27 is driven by a conventional drive means 2, which is operatively connected to the control unit 50.

With further regard now to FIG. 2, the relocating means 7 will now be described in further detail. An assembly for disposing a yarn end into the tube 10 of a package 1 includes a suction assembly 17 having a suction tube connected to a suction source (not shown) and having the open end of the suction tube positioned above the package 1 positioned in the repositioning means 7. A conventional yarn end stripping device 16 is operable to strip or otherwise displace a yarn end within a predetermined, relatively limited axial extent of a package 1 for engagement of the yarn end by the suction applied through the suction assembly 17. A conventional yarn end cutting device 19 is positioned in the suction assembly 17 for cutting a yarn end drawn into the suction tube of the suction assembly. A valve 18 is positioned downstream of the conventional yarn end cutting device 19 for controlling the application of suction through the suction assembly 17. A sensor 20 is positioned between the conventional yarn end cutting device 19 and the free end of the suction assembly 17 for sensing the presence of a yarn end in the suction assembly 17. A conventional yarn brake 15 is supported relative to the yarn end stripping device 16 for controlling the extent of the yarn end drawn into the suction assembly 17.

As shown by the solid lines in FIG. 2 and the broken lines in FIG. 4, the repositioning means 7 further includes a tube suction device 12 connected to a suction source (not shown), which is operable to apply a suction, via the air guide channels 31, through the tube 10 of a package 1. A valve 13, which is operatively connected to the control unit 50, is operable to control the suction applied by the tube suction device 12.

The operation of the yarn end disposing appartatus illustrated in FIGS. 1–4 is as follows. The ring spinning machine 2 builds yarn onto the tubes 10 to form the yarn packages 1. The yarn packages 1 are transported from the ring spinning machine 2 by the yarn package transport assembly 3 to the transfer location 4 for transfer to the rotating disk assembly of the advancing means 5. The control unit 50 controls the operation of the motor 53 to regulate the transport of the package 1 to the transfer location 4. The control unit 50 controls the motor 52 to rotate the rotating disk assembly to successively individually bring the package receiving devices 0–23 on the rotating disk assembly into alignment with the transfer location 4 for individual transfer of the packages 1 onto the package receiving devices 0–23.

As each package 1 is transferred from the transfer location 4 onto one of the package receiving devices 0–23 of the rotating disk assembly, the sensor 40 senses the position of the yarn end relative to the yarn package and transmits the sensed information to the control unit 50. The supported package 1 is then advanced by the rotating disk assembly, upon the next controlled movement of the rotating disk assembly, towards the preliminarily repositioning means 6. In response to the information transmitted by the sensor 40, the control unit 50, in coordination with the shift register 51, activates the preliminarily repositioning means 6 to engage the yarn end of the package 1 when the package is positioned in the preliminarily repositioning means 6. Specifically, if the sensor 40 senses that the yarn end of the package 1 is displaced from a preferred preliminary disposition (such as, for example, within a predetermined, relatively limited axial extent of the upper portion of the package), the control unit 50 activates the preliminarily repositioning means 6 to engage the yarn end of the package 1. Specifically, the control unit 50 opens the valve 25 to apply a suction, via the slot of the suction tube 22, to the axial extent of the package 1 while simultaneously controlling the motor 28 to rotate the drive disk 27 to thereby rotate the package 1 about its axis in an unwinding direction. Accordingly, the yarn end of the package 1 is drawn into the suction tube 22 and eventually moves into alignment with the yarn guide 26 and the conduit 23. Once the yarn end is positioned on the yarn guides 26, the sensor 48 senses the presence of the yarn end in the conduit 23 and signals the control unit 50 to close the valve 25 to cease the application of suction through the suction tube 22. Additionally, the yarn end cutting device 24 is controlled by the control unit 50 to cut the yarn ends.

Once the yarn end cutting device 24 has cut the yarn end, the control unit 50 controls the motor 28 to further rotate the package 1 to wind the now-cut yarn end onto the upper, exposed portion of the tube 10 of the package 1.

Following the passage of each package 1 through the preliminarily repositioning means 6, the control unit 50 continues to advance the packages 1 through rotation of the rotating disk assembly of the advancing means 5. Accordingly, after the package 1 has been advanced from the preliminarily repositioning means 6 at which its yarn end was either preliminarily repositioned from a displaced disposition to the preferred preliminary disposition or not treated by the preliminarily repositioning means 6, the package 1 is eventually advanced to the relocating means 7, as indicated by the package receiving location 6 in FIG. 1. Since the packages either were initially loaded onto the rotating disk assembly with a yarn end already in the preferred preliminary disposition or their yarn ends were placed in the preferred preliminary disposition at the preliminarily repositioning means 6, each of the packages arriving at the relocating means 7 ideally has its yarn end in the preferred preliminary disposition and can be handled by the relocating means 7 to dispose the yarn end into the tube 10 of the package. However, sometimes even the handling of a package by the preliminary repositioning means 6 fails to reposition the yarn end of the package from a displaced disposition to the preferred preliminary disposition and the relocating means 7 is unable to relocate the yarn end of the package from the preferred preliminary disposition to the further handling disposition, in which event the package is further advanced as described in more detail below.

The operation of the relocating means 7 is as follows. The control unit 50 opens the valve 18 to permit a suction to be applied through the suction assembly 17 and the control unit simultaneously controls the yarn stripping device 16 and the yarn brake 15 to effect unwinding of the yarn end of the package 1 from its preferred preliminary disposition for engagement by the suction applied through the suction assembly 17. If the yarn end is successfully drawn into the suction assembly 17, the sensor 20 senses the presence of the yarn end and signals the control unit 50 to close the valve 18 to cease the application of suction and to operate the conventional yarn end cutting device 19 to cut the yarn end to a predetermined length. Once the yarn end has been cut to a predetermined length, the control unit 50 opens the valve 13 to permit a suction to be applied through the tube 10 via the tube suction device 12, thereby causing the yarn end to be drawn into the tube 10. The package 1 is then ready for movement to a transfer position for transfer to the yarn package transport assembly 8.

If the sensor 20 fails to sense the presence of a yarn end in the suction assembly 17, the sensor 20 signals the control unit 50 concerning the failure to sense the yarn end whereupon the control unit 50, in cooperation with the shift register 51, controls the movement of the package 1 to avoid transfer of the package to the yarn package transport assembly 8.

Those packages whose yarn ends are not successfully disposed in the package tube at the relocating means 7 remain on the rotating disk assembly and are again advanced to the preliminarily repositioning means 6 for another attempt to reposition the yarn end of the package in the preferred preliminary disposition. Subsequently, the packages are again advanced to the relocating means 7 for another attempt to dispose their yarn ends in their tubes. After a predetermined number of cycles of such packages through the preliminarily repositioning means 6 and the relocating means 7 without successful positioning of the yarn ends in the package tubes, the packages are ejected at the defective package device 8' for manual or other handling of the package to position its yarn end in the preferred preliminary disposition. Packages which are handled in such a manner at the defective package device 8' are returned to the rotating disk assembly by positioning the package on an available package receiving device on the rotating disk assembly within the region 3' of the rotating disk assembly.

As can be understood, the control unit 50 controls each component of the yarn end disposing apparatus to transfer packages in a coordinated manner from the transfer location 4 onto the rotating disk assembly, to transfer packages from the rotating disk assembly to the yarn end transport assembly 8 and to eject packages to the defective package device 8'.

One variation of the embodiment of the yarn end disposing apparatus illustrated in FIGS. 1–5 includes positioning the preliminarily repositioning means 6 in the position relative to the rotating disk assembly indicated by the broken lines designated 6' in FIG. 1. In this arrangement, each package is intitially moved into position at the relocating means 7 before reaching the preliminarily repositioning means 6. Accordingly, each package whose yarn end is not successfully repositioned by the relocating means 7 is either ejected at the defective package device 8' or advanced therepast to the preliminarily repositioning means 6 for handling thereat. In this regard, the preliminarily repositioning means 6 can be provided with a sensor 57 operatively connected to the control unit 50. The sensor 57 signals the control unit 50 concerning the presence of a package at the preliminarily repositioning means 6, whereby the control unit 50 can control the preliminarily repositioning means 6 to handle the package in the manner described above.

Figure 6:
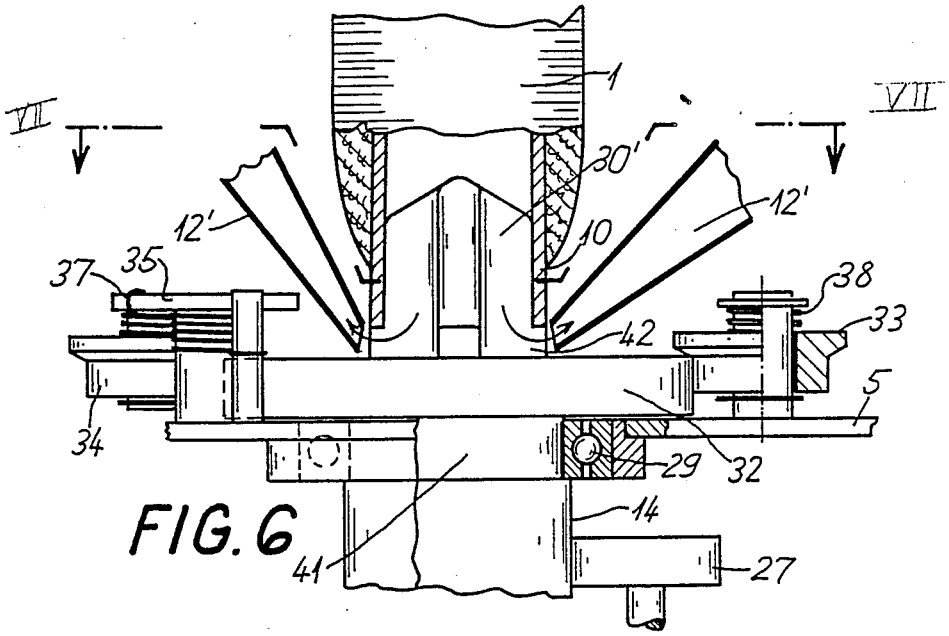
FIG. 6 is a partial front elevational view, in partial vertical section, of another form of the relocating means shown in FIG. 2.
Figure 7:
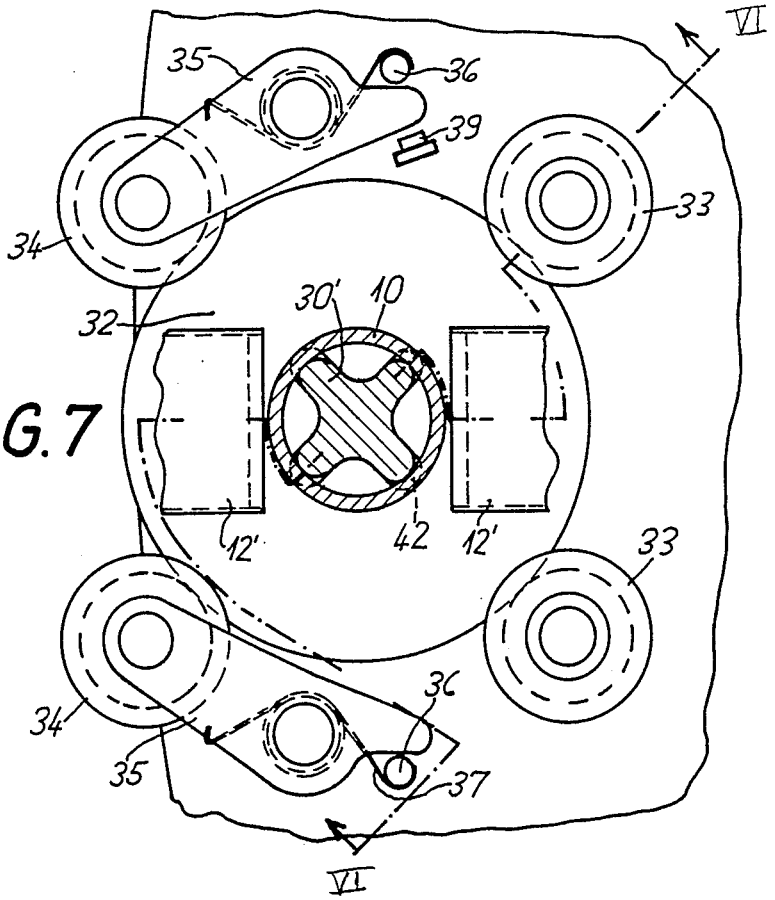
FIG. 7 is a top plan view of the relocating means shown in FIG. 6, taken along line VII—VII of FIG. 6.

With reference now to FIGS. 6 and 7, another form of the relocating means 7 and the package receiving devices 0–23 of the rotating disk assembly are illustrated. Each package receiving device 0–23 of the rotating disk assembly includes a pair of spaced, stationary rollers 33 mounted to the rotating disk assembly for rotation about their axes, a tube receiving plate 32 having a radially enlarged portion and a tube insertion portion 30' projecting therefrom, and a pair of movable roller assemblies 34. The insertion portion 30' is adapted to snugly receive the tube 10 of a package 1 inserted thereon and includes a plutality of shoulders 42 for supporting the tube 10 at a predetermined extent above the enlarged radial portion of the tube insertion plate 32. Each movable roller assembly 34 includes an arm 35 pivotally mounted to the rotating disk assembly, a roller rotatably mounted to the free-end of the pivoting arm 35 and a spring 37 operatively connected to the pivoting arm 35 and a stop 36 mounted to the rotating disk assembly.

The pivoting arms 35 pivot in opposite directions relative to one another and are located relative to the stationary rollers 33 to compressibly grip the enlarged radial portion of the tube insertion plate 32 between the rollers thereon and the stationary rollers 33. The stops 36 limit the pivoting of the pivoting arm 35. The springs 37 continuously bias the rollers of the movable roller assemblies 34 against the tube insertion plate 32 such that the tube insertion plate 32 is securely mounted to the rotating disk assembly yet is free to rotate about its axis under the driving operation of the drive disk 27, as seen in FIG. 6.

To rotate the package 1 during the operation of the relocating means 7, a rotating plate 41 is rotatably mounted to the rotating disk assembly by a conventional ball bearing assembly 29 and a drive whorl 14 is connected to the rotating disk 41. The rotating disk 41 extends axially beyond the rotating disk assembly to support the tube insertion plate 32 at a slight spacing above the rotating disk assembly. Accordingly, the drive disk 27 is operable to rotate the rotating disk 41 via driving rotation of the drive whorl 14. Rotation of the rotation disk 41 produces rotation of the tube insertion plate 32 and, thereby, rotation of the package 1 supported on the tube insertion plate 32, about its axis. A sensor 39 can be provided adjacent one of the pivoting arms 35 to sense movement of the pivoting arm in response to receipt of a package into the respective package receiving location of the rotating disk assembly. The sensor 39 is operatively connected to the control unit 50 to indicate the receipt of a package at the package receiving location of the rotating disk assembly.

The modified relocating means 7 shown in FIGS. 6 and 7 includes a pair of suction arms 12′ in lieu of the tube suction device 12 and the valve 13 of the relocating means 7 illustrated in FIGS. 1–4. Each suction arm 12′ is positioned such that its open free end is closely adjacent the bottom of the tube 10 of a package 1 supported in the relocating means 7. Each suction arm 12′ is connected to a suction source (not shown) for applying a suction, via the suction arm, through the tube 10 to draw the yarn end into the tube.

Figure 8:
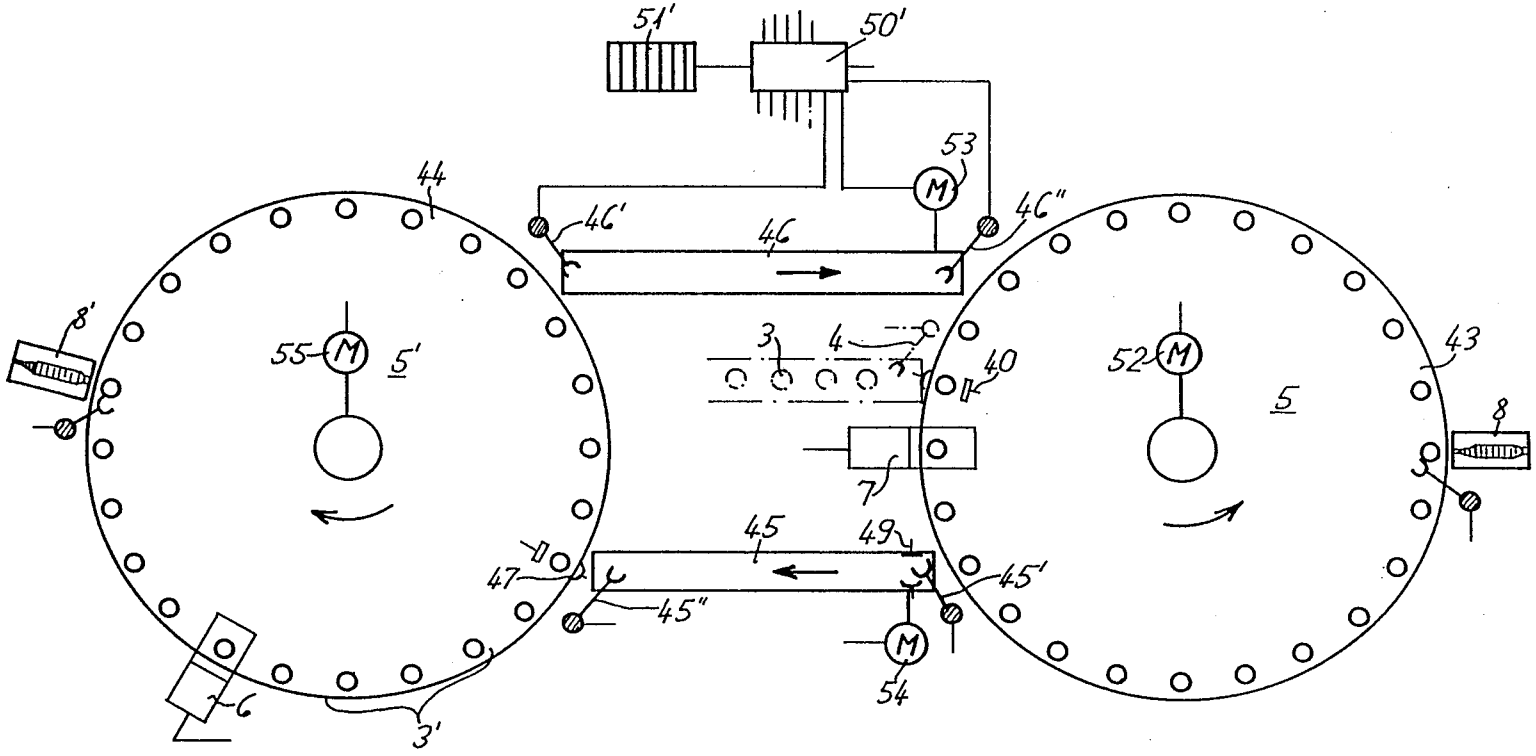
FIG. 8 is another embodiment of the yarn end disposing apparatus of the present invention.

In FIG. 8, another embodiment of the yarn end disposing apparatus of the present invention is illustrated. The apparatus includes a preliminarily repositioning means 6 and a relocating means 7 of the type discussed with respect to the embodiment illustrated in FIGS. 1–5 and a modification of the advancing means 5. Specifically, the modification of the advancing means 5 includes a pair of rotating disk assemblies 43, 44. The preliminarily repositioning means 6 is positioned relative to the rotating disk assembly 44 for receipt of packages carried by the rotating disk assembly. The relocating means 7 is positioned relative to the other rotating disk assembly 43 for receipt of packages carried by that rotating disk assembly. An interconnecting transport assembly 45 extends between the rotating disk assemblies 43, 44 and a return transport assembly 46 extends between the two rotating disk assemblies. The yarn package transport assembly 3, which transports packages from the ring spinning machine 2 to a transfer location 4 for transfer to the rotating disk assembly 43, is operable to deliver packages to the transfer location 4 as discussed with respect to the embodiment illustrated in FIGS. 1–5. The rotating disk assembly 43 is rotated via a motor 52 which is operatively connected to a control unit 50′. Similarly, the rotating disk assembly 44 is rotated by a motor 55 operatively connected to the control unit 50′.

The interconnecting transport assembly 45 includes an endless belt assembly having an endless belt, a transfer device 45′ for transferring packages from the rotating disk assembly 43 to the interconnecting transport assembly 45 and a second package transfer device 45″ for transferring packages from the assembly 45 to the rotating disk assembly 44. The endless belt includes conventional means for supporting packages for subsequent transfer from the interconnecting transport assembly 45. The transfer devices 45′, 45″ are each individually operatively connected to the control unit 50′. Additionally, the interconnecting transport assembly 45 includes a motor 54 for driving the endless belt between the package transfer devices 45′, 45″ and the motor 54 is operatively connected to the control unit 50′. A conventional sensor device is positioned adjacent the transfer device 45′ to sense the transfer of a package from the rotating disk assembly 43 to the interconnecting transport assembly 45. Similarly, a conventional sensor device 47 is positioned adjacent the second transfer device 45″ to sense the transfer of a package from the interconnecting transport assembly 45 to the rotating disk assembly 44. The sensors 47, 49 are operatively connected to the control unit 50′.

The return transport assembly 46 includes a transfer device 46′ for transferring packages from the rotating disk assembly 44 to the return transport assembly 46 and a second transfer device 46″ for transferring packages from the return transport assembly to the rotating disk assembly 43. The transfer devices 46′, 46″ are each individually operatively connected to the control unit 50′. The return transport assembly 46 additionally includes an endless belt extending between the transfer devices 46′, 46″ and a motor 53 for driving the endless belt. The motor 53 is operatively connected to the control unit 50′.

The yarn end disposing apparatus illustrated in FIG. 8 additionally includes a conventional package transport assembly 8 for receiving defective packages transferred from the rotating disk assembly 43 for transport to a winding machine or the like and a defective package device 8′ for receiving defective packages transferred from the rotating disk assembly 44. Additionally, the apparatus includes a conventional counting device such as, for example, a shift register 51′, which is operatively connected to the control unit 50′.

The yarn end disposing apparatus illustrated in FIG. 8 operates as follows. As packages are delivered to the transfer location 4 by the yarn package transport assembly 3, the control unit 50′ controls the transfer of the packages to the rotating disk assembly 43 to insure that each package is individually received at the one of the package receiving locations spaced angularly uniformly along the rotating disk assembly. As each package is received on the rotating disk assembly 43, the sensor 40 senses the disposition of the yarn end of the package relative to the package and transmits this information to the control unit 50′. By controlling the operation of the motor 52, the control unit 50′ effects advancement of packages on the rotating disk assembly 43 to the relocating means 7. At the relocating means 7, each package is handled to effect disposition of its yarn end into its tube. Each package which is successfully handled by the relocating means 7 is transferred to the conventional package transport assembly 8 for transport to the winding machine. If the sensor 20 of the relocating means 7 fails to detect the presence of the yarn end in the suction assembly 17, the control unit 50′ notes this information and controls the operation of the transfer device 45′ to effect transfer of the package from the rotating disk assembly 43 to the interconnecting transport assembly 45.

The control unit 50′ controls the operation of the motor 54 to move the endless belt of the interconnecting transport assembly 45. Accordingly, a package on the endless belt is eventually positioned for transfer by the second transfer device 45″ to the rotating disk assembly 44. Once the package is received on the rotating disk assembly 44, the sensor 47 signals the control unit 50′ concerning the presence of the package on the rotating disk assembly and the control unit 50′ accordingly controls the operation of the preliminarily repositioning means 6 to effect handling of the package at the means 6. The preliminarily repositioning means 6 handles the package to reposition the yarn end of the package from its displaced position to the preferred preliminary disposition, as described with respect to the embodiment illustrated in FIGS. 1–5.

If the package is successfully handled at the preliminarily repositioning means 6, the package is transferred by the transfer device 46' from the rotating disk assembly 44 to the endless belt of the return transport assembly 46. On the other hand, if the package is not successfully handled by the preliminarily repositioning means 6, the package remains on the rotating disk assembly 44 and is again handled by the preliminarily repositioning means 6. After a predetermined number of attempts to handle the package at the preliminarily repositioning means 6, the control unit 50' controls the defective package device 8' to effect transfer of the package from the rotating disk assembly to the defective package device 8', whereby the package can be manually handled to dispose its yarn end in position for proper handling by the preliminarily repositioning means 6. Such packages can be reinserted on the rotating disk assembly 44 in the region indicated by 3' in FIG. 8.

The packages transferred from the rotating disk assembly 44 to the return transport assembly 46 are eventually transferred to the rotating disk assembly 43 by the second transfer device 46''. These packages are transferred to the rotating disk assembly 43 in advance of the relocating means 7 so that the packages can again be handled by the relocating means 7 to dispose their yarn ends in the package tubes. If the package again fails to be successfully handled by the relocating means 7, the control unit 50' controls the interconnecting transport assembly 45 to transfer the package from the rotating disk assembly 43 to the rotating disk assembly 44 and from there to the defective package device 8' for manual handling or other handling of the package.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. An apparatus for disposing the yarn end of each of a plurality of packages in a further handling disposition, each package being of the type having yarn built onto a tube and some of the packages having their yarn ends in a preferred preliminary disposition and other of the packages having their yarn ends in a disposition displaced from the preferred preliminary disposition, comprising:

means for preliminarily repositioning the yarn ends of packages having displaced yarn ends from a displaced disposition to the preferred preliminary disposition;

means for relocating the yarn ends of packages having yarn ends in the preferred preliminary disposition from the preferred preliminary disposition to the further handling disposition;

means for selectively operating said preliminary repositioning means to preliminarily reposition the yarn ends of only those packages having displaced yarn ends; and means for advancing packages between said preliminarily repositioning means and said relocating means.

2. An apparatus according to claim 1 and characterized further in that the preferred preliminary disposition of a yarn end of a package is a disposition within a predetermined, relatively limited axial extent of the package and said relocating means includes an assembly for engaging a yarn end of a package disposed within said predetermined, relatively limited axial extent of the package.

3. An apparatus according to claim 2 and characterized further in that the further handling disposition of a yarn end of a package is a disposition in the end of the tube of the package and said engaging assembly includes a component for disposing a yarn end into the tube of a package.

4. An apparatus according to claim 3 and characterized further in that said engaging assembly includes a device for cutting a yarn end removed from said predetermined, relatively limited axial extent of the package to a predetermined length.

5. An apparatus according to claim 4 and characterized further in that said engaging assembly includes a device for applying suction to the exterior of a package to within the predetermined, relatively limited axial extent of the package.

6. An apparatus according to claim 5 and characterized further in that said disposing component includes a member for applying suction through the tube to draw the yarn end into the tube in the direction of the suction.

7. An apparatus according to claim 6 and characterized further in that said device for cutting a yarn end includes a device, cooperatively operated with said device for applying a suction to the exterior of a package, to cut to a predetermined length a yarn end drawn into said device for applying a suction to the exterior of a package.

8. An apparatus according to claim 1 and characterized further by means for identifying packages having yarn ends displaced from the preferred preliminary disposition, said preliminarily repositioning means being responsive to said identifying means to change the disposition of the yarn end of a package, identified by said identifying means as displaced, from the displaced disposition to the preferred preliminary disposition.

9. An apparatus according to claim 8 and characterized further in that said advancing means advances packages from said preliminary repositioning means to said relocating means.

10. An apparatus according to claim 8 and characterized further in that said advancing means includes a first cycling device for cyclically moving packages in a loop to said relocating means for handling thereby, a second cycling device for cyclically moving packages in a loop to said preliminarily repositioning means for handling thereby, an interconnecting transport assembly for transporting a package from said first cycling device to said second cycling device in response to a signal from said identifying means indicating that the package has its yarn end in a displaced disposition, and a return transport assembly for transporting a package from said second cycling device to said first cycling device, after the package has been handled by said preliminarily repositioning means, to reposition its yarn end from a displaced disposition to the preferred preliminary disposition.

11. An apparatus according to claim 1 and characterized further by means, operatively connected to said advancing means, for discharging from said advancing means packages which still have yarn ends in a displaced disposition after a predetermined number of cycles of handling by said relocating means.

12. An apparatus according to claim 11 and characterized further in that said advancing means includes a device for cyclically moving packages between said relocating means and said preliminarily repositioning means and said discharging means is selectively deactivated to permit movement of packages by said cyclical moving device.

13. An apparatus according to claim 1 and characterized further in that said preliminarily repositioning means includes an assembly, operatively connected to said advancing means, for rotating a package about its axis, a device for applying a suction substantially along the axial extent of a package being rotated by said package rotating assembly to effect unwinding of a yarn end from the package and a device for cutting to a predetermined length a yarn end drawing into said suction device.

14. An apparatus according to claim 13 and characterized further in that said preliminarily repositioning means includes a sensing device for sensing the presence of a yarn end in said suction device.

15. An apparatus according to claim 1 and characterized further by control means, connected to said preliminarily repositioning means, said relocating means and said advancing means, for coordinating the operation of said respective means with one another.

16. An apparatus according to claim 15 and characterized further in that said preliminarily repositioning means includes a sensing device for sensing the presence of a yarn end and said control means deactivates said preliminarily repositioning means when said sensing device senses that no yarn end is present.

17. A method for disposing the yarn end of each of a plurality of packages in a further handling disposition, each package being of the type having yarn built onto a tube and some of the packages having their yarn ends in a preferred preliminary disposition and other of the packages having their yarn ends in a disposition displaced from the preferred preliminary disposition, comprising:

preliminarily repositioning the yarn ends of packages having displaced yarn ends from a displaced disposition to the preferred preliminary disposition; and relocating the yarn ends of packages having yarn ends in the preferred preliminary disposition from the preferred preliminary disposition to the further handling disposition.

18. A method according to claim 17 and characterized further by identifying packages having yarn ends displaced from the preferred preliminary disposition and said preliminarily repositioning the yarn ends occurs in response to the identification of a package having its yarn end displaced.

19. A method according to claim 17 and characterized further in that said preliminarily repositioning the yarn ends and said relocating the yarn ends occurs automatically and by automatically sequentially performing said preliminarily repositioning the yarn ends and said relocating the yarn ends on a given package for a predetermined number of times and transferring said given package after said predetermined number of times to a location for remedial handling to place the yarn end of said given package into the preferred preliminary disposition.

20. A method according to claim 19 and characterized further by relocating the yarn end of said given package from the preferred preliminary disposition to the further handling disposition.

* * * * *